US006978562B2

(12) United States Patent
Frenkel

(10) Patent No.: US 6,978,562 B2
(45) Date of Patent: Dec. 27, 2005

(54) GREETING CARD

(76) Inventor: Aliza Frenkel, 11HaRechesh St., Afeka, Tel Aviv 69699 (IL)

( * ) Notice: Subject to any disclaimer, the term of this patent is extended or adjusted under 35 U.S.C. 154(b) by 0 days.

(21) Appl. No.: 10/474,819

(22) PCT Filed: Nov. 13, 2002

(86) PCT No.: PCT/IL02/00906

§ 371 (c)(1),
(2), (4) Date: May 11, 2004

(87) PCT Pub. No.: WO2004/043707

PCT Pub. Date: May 27, 2004

(65) Prior Publication Data

US 2004/0206640 A1 Oct. 21, 2004

(51) Int. Cl.[7] ..... G09F 1/00
(52) U.S. Cl. ..... 40/124.06; 206/232; 229/71
(58) Field of Search ..... 206/39, 232, 308.3, 206/449, 769, 772; 40/490, 491, 124.06; 229/68.1, 71, 84, 92.8, 92.9

(56) References Cited

U.S. PATENT DOCUMENTS

| | | | | | |
|---|---|---|---|---|---|
| 856,196 | A | * | 6/1907 | Lehman | 273/155 |
| 1,576,636 | A | * | 3/1926 | Egan | 40/124.06 |
| 2,782,542 | A | * | 2/1957 | Blevens | 40/754 |
| 3,061,173 | A | * | 10/1962 | Sawdon | 229/300 |
| 3,174,244 | A | | 3/1965 | Walton | |
| 3,181,774 | A | * | 5/1965 | Littman | 229/70 |
| 3,195,802 | A | * | 7/1965 | Jacobs | 229/72 |
| 3,266,714 | A | * | 8/1966 | Heuberger | 229/92.8 |
| 3,522,908 | A | * | 8/1970 | Carrigan | 229/72 |
| 4,433,780 | A | | 2/1984 | Ellis | |
| 4,813,902 | A | | 3/1989 | Messer | |
| 5,096,058 | A | | 3/1992 | Juravin et al. | |
| 5,377,904 | A | | 1/1995 | Michlin et al. | |
| 5,822,896 | A | | 10/1998 | Milstein | |
| 5,822,897 | A | | 10/1998 | Ertzan | |
| 5,988,372 | A | * | 11/1999 | Kawagoe et al. | 206/232 |
| 6,003,254 | A | | 12/1999 | Lorber | |
| 6,024,278 | A | * | 2/2000 | Martin | 229/92.8 |

(Continued)

FOREIGN PATENT DOCUMENTS

| | | |
|---|---|---|
| CA | 2027307 | 11/1992 |
| DE | 85 19 447.6 | 1/1986 |
| GB | 2143177 A | 2/1985 |
| GB | 2316359 A | 2/1998 |
| JP | 63178375 | 1/1990 |
| JP | 06330112 | 6/1996 |

*Primary Examiner*—Mickey Yu
*Assistant Examiner*—Jerrold Johnson
(74) *Attorney, Agent, or Firm*—Nath & Associates PLLC; Gregory B. Kang; Derek Richmond

(57) ABSTRACT

A greeting card made of a single sheet of material and adapted for holding a substantially flat object, comprises at least two sections separated by a single folding line, a first of the two sections having a smaller dimension than the second section in the direction perpendicular to the folding line. One of the two sections is formed with at least one slit spaced from the folding line and the other section is formed with at least one slit-engaging portion insertable into the at least one slit when the greeting card is folded along the folding line. Thereby, the first section lies flat over the second section and a pocket is formed for holding a flat object.

18 Claims, 3 Drawing Sheets

U.S. PATENT DOCUMENTS 6,106,023 A 8/2000 Sud et al.
6,148,550 A 11/2000 Niedfeld
6,416,243 B1 7/2002 Castro
6,588,591 B1 * 7/2003 Schabert et al. ..... 206/441
2002/0100797 A1 8/2002 Hollingsworth et al.
2003/0080178 A1 * 5/2003 Sharp et al. ..... 229/87.01

* cited by examiner

GREETING CARD

FIELD OF THE INVENTION

This invention relates to the field of greeting cards in general and particularly to the field of greeting cards that hold flat objects such as photographs, cheques, and the like.

BACKGROUND OF THE INVENTION

A greeting card is a commodity produced on large scale and in a vast range of forms and shapes. Frequently, it is used on holidays and celebrations, where it is given along with a present. For example, U.S. Pat. No. 5,096,058 discloses a greeting card folded to form a compartment having a volume for storing a box of candies or the like.

Often, the present is in the form of a cheque or cash inserted in an envelope together with a greeting card. Greeting cards incorporating flat objects such as cheques or photographs are disclosed, for example, in GB 2143177A, U.S. Pat. Nos. 5,822,896, 5,822,897, 6,148,550, and others.

U.S. Pat. No. 6,148,550 relates to the manufacturing of a greeting card including a money pocket attached to its internal surface by means of an adhesive agent.

U.S. Pat. No. 5,822,897 provides a reversible greeting, letter and/or photograph frame with cover, which may be folded to a self-contained structure to be mailed without an envelope, and which may be reversed into a photo-stand to hold a photograph.

U.S. Pat. No. 5,822,896 provides a dioramic greeting card constructed of three panels, one of which is formed with a window through which a picture or writing, printed or adhered on another panel, can be seen.

GB 2143177 refers to folding a one-piece blank into a six-fold greeting card including a window that allows the viewing of a photograph inserted therein.

SUMMARY OF THE INVENTION

In accordance with the present invention, there is provided a greeting card with a pocket for holding a substantially flat object, made of a single sheet of material and comprising two sections separated by a single folding line, a first of said two sections having a smaller dimension than the second section in the direction perpendicular to the folding line. One of the sections is formed with at least one slit spaced from the folding line and the other section is formed with at least one slit-engaging portion insertable into said at least one slit. The greeting card is designed so that, when it is folded along the folding line and the slit-engaging portion in one of the sections is inserted into the slit in the other section, the first section lies flat over the second section, whereby a flat pocket is formed adapted for tightly holding a flat object. Since the sections have different dimensions, the pocket occupies only a part of the larger section, whereby some space may be left free for greetings or other suitable notes.

In one embodiment, the at least one slit is formed in the second section of the greeting card, and the slit-engaging portion is formed in the first section of the greeting card. The slit in the second portion may be parallel to the folding line with the slit-engaging portion in the first section being in the form of a tab accordingly projecting from the edge of the first portion opposite the folding line. Alternatively, the second section of the greeting card may have a plurality of slits, which may be oriented transversely to the folding line, with slit-engaging portions being located at the side edges of the first section. Also, the second section may comprise two diagonal slits positioned to receive two respective corners of the first section.

Other embodiments are possible, where the slit or slits are formed in the first section and the slit-engaging portions are formed in the second section, or the first and the second sections are each formed with both a tab and a slit to form slit-tab interengaging pairs with corresponding slit and tab of the other section.

Dimensions of the first and second sections in the direction parallel to the folding line may be equal or may differ. For example, the first section may be shorter than the second section. Shapes of the first and second sections may vary. Also, the design of the slit-engaging portion and the slits may vary as well as their dimensions.

It is desirable in all the above embodiments that the distance between the slit and the folding line and, consequently, the corresponding dimension of the pocket formed in the greeting card, be substantially equal to the corresponding dimension of the flat object to be held by the card. This is particularly applicable to cheques which are normally of standard dimensions.

In addition, the first section may be formed with a cutout, in a location adjacent to said slit-engaging portion, extending along at least most of the length of the slit-engaging portion, whereby a holding area is formed in the first section between the cutout and the slit-engaging portion, adapted to exert pressure on the flat object when held in the pocket of the greeting card. Additionally, or alternatively, the cutout may serve as a window in the pocket, enabling the recipient of the card to see the flat object held in the pocket without taking it out or opening the pocket.

The greeting card may further comprise a side flap projecting from one of side edges of the second section. The flap is preferably separated from the second section by one additional folding line and is adapted to cover the window, giving the greeting card further aesthetic value. The flap is preferably detachably attachable to the first section, when said greeting card is folded along the folding line between the first and second sections and when the flap is folded along the additional folding line.

The greeting card may further comprise a third section substantially equal in size to the second section, separated therefrom by a second additional folding line parallel to the folding line between the first and second sections. When this third section is folded along the second additional folding line, it covers the second section with the pocket, with the side flap attached thereto (when the card has such side flap), to form an external face of the greeting card.

The greeting card in accordance with the present invention is simple and inexpensive in manufacture, being made of a single sheet of material without any need for adhesive means. It has a relatively small number of sections and, consequently, a small number of folding lines, and is easily foldable by a user. It is particularly advantageous for enhousing such popular gifts as cheques or cash money, since they may be safely held by the pocket of the greeting card.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
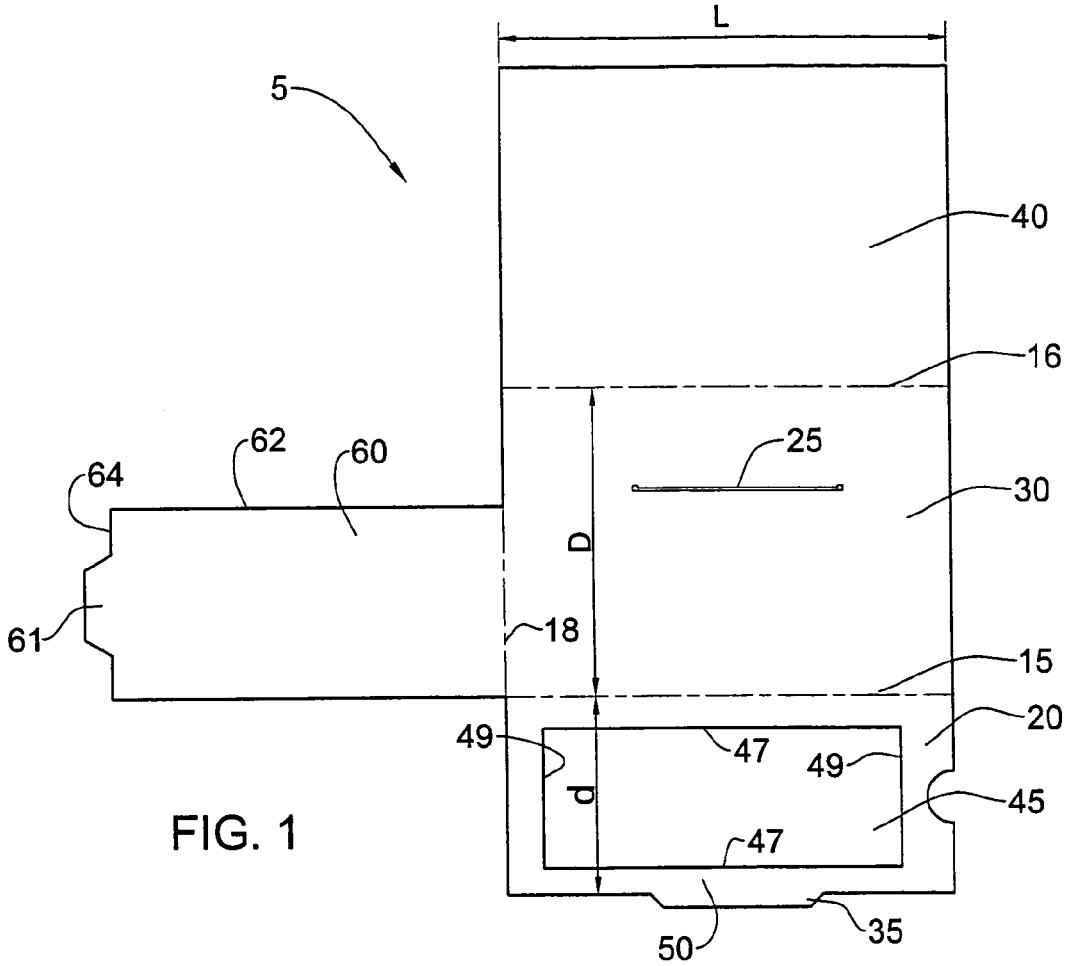
FIG. 1 is a plan view of a sheet of material for forming a greeting card in accordance with the present invention.
Figure 2:
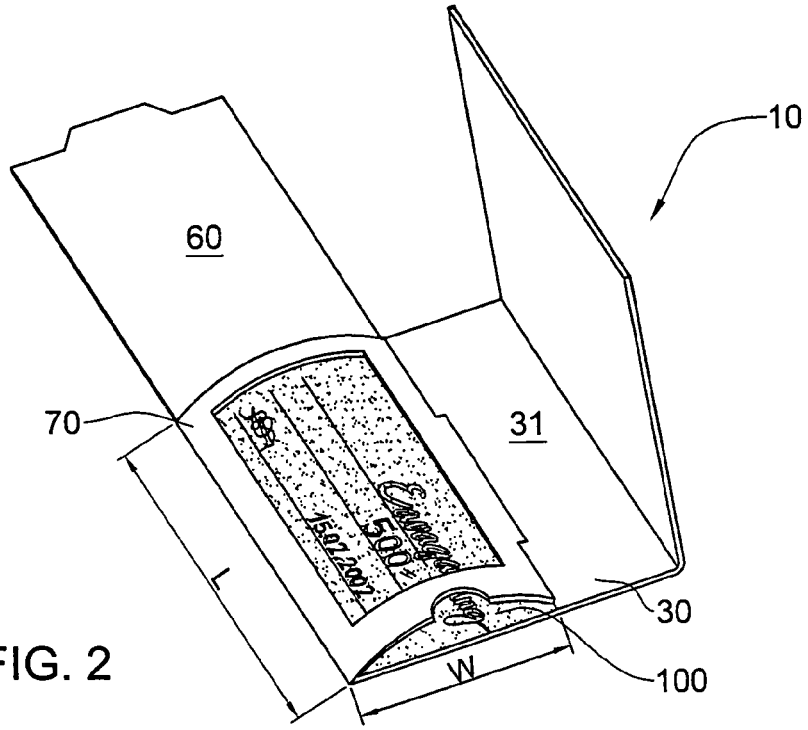
FIG. 2 is a perspective view of the sheet shown in FIG. 1, in the process of being folded to form a pocket in the greeting card of the present invention.
Figure 4:
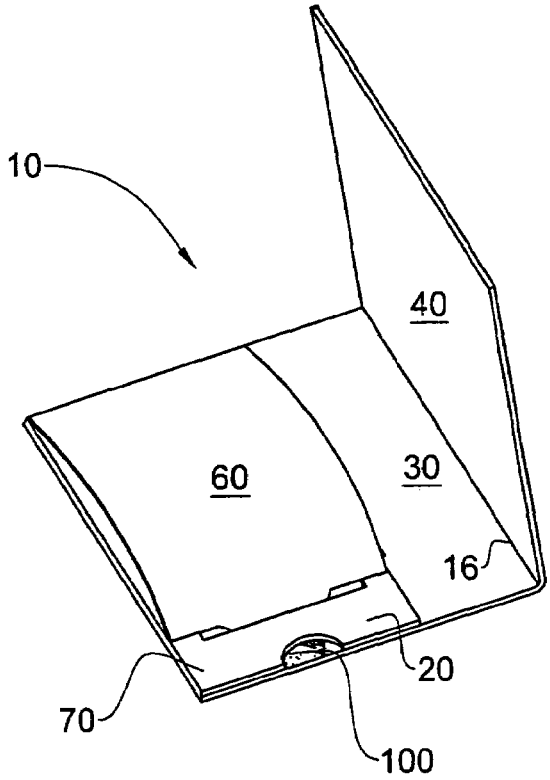
FIG. 4 is a perspective view of a greeting card in accordance with the present invention, with a pocket and a flap covering it.

FIG. 1 shows a sheet 5 of material for forming a greeting card 10 in accordance with one embodiment of the present invention, depicted in FIGS. 2 and 4. The material of which the sheet is made may be any material conventionally used for greeting cards such as cardboard, plastic and the like. The greeting card is designed for holding a flat object 100 such as a cheque having a length l and a width w. It should be noted that, when it is desired that the greeting card be of a compact design, the flat object may be held there in a folded state, in which case the dimensions l and w characterize the object when folded.

The sheet 5 comprises a first section 20, a second section 30 and a third section 40. The first and the second sections 20 and 30 are separated by a folding line 15, and the second and the third sections 30 and 40 are separated by a folding line 16. The lengths of the folding lines 15 and 16, as well as of the corresponding dimension L of the entire sheet, are preferably not shorter than the length l of the flat object 100.

The first section 20 has a smaller dimension d than the corresponding dimension D of the second section 30, the dimension d being not less and, preferably, essentially equal to the width w of the flat object to be held by the greeting card 10.

The second section 30 is formed with a slit 25 parallel to the folding line 15 and spaced therefrom to a distance equal or slightly greater than the dimension d referred to above. Preferably, the length of the slit is between 25% and 75%, in particular between 40% and 60%, of the length of the folding line 15. The first section 20 is formed with a slit-engaging portion in the form of a tab 35 whose length is slightly less than the length of the slit 25 and whose width in the direction perpendicular to the slit, is only that large as to ensure the sufficiently firm interengagement between the slit and the tab.

Figure 3A:
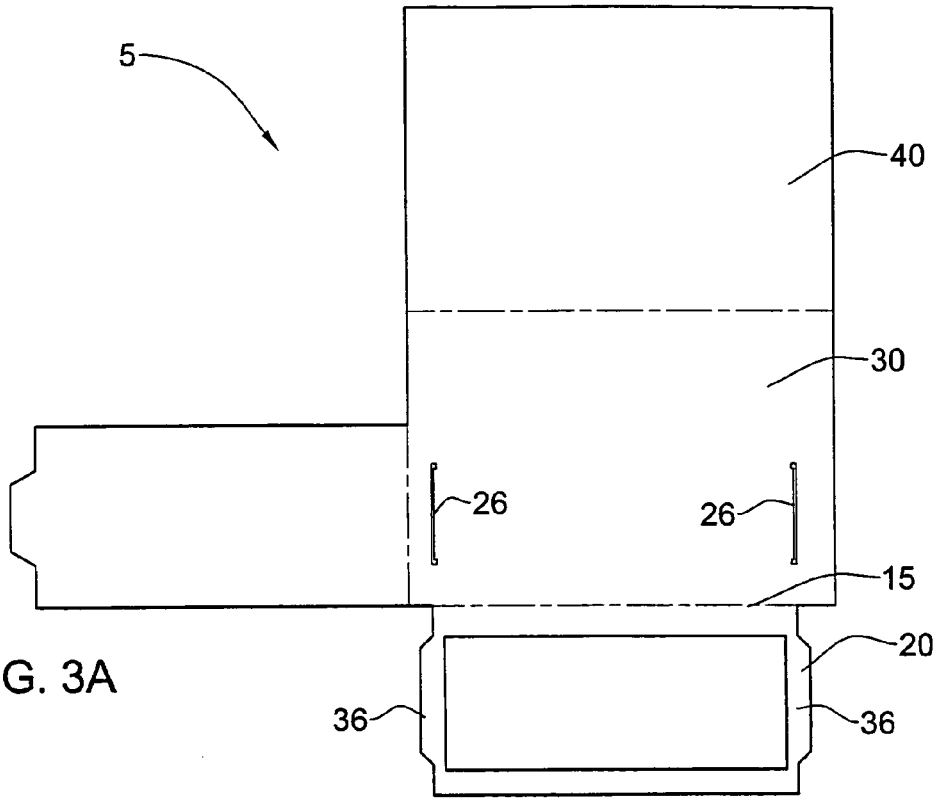
FIGS. 3A and 3B are plan views of a sheet of which a greeting card is made in accordance with alternative embodiments of the present invention.
Figure 3B:
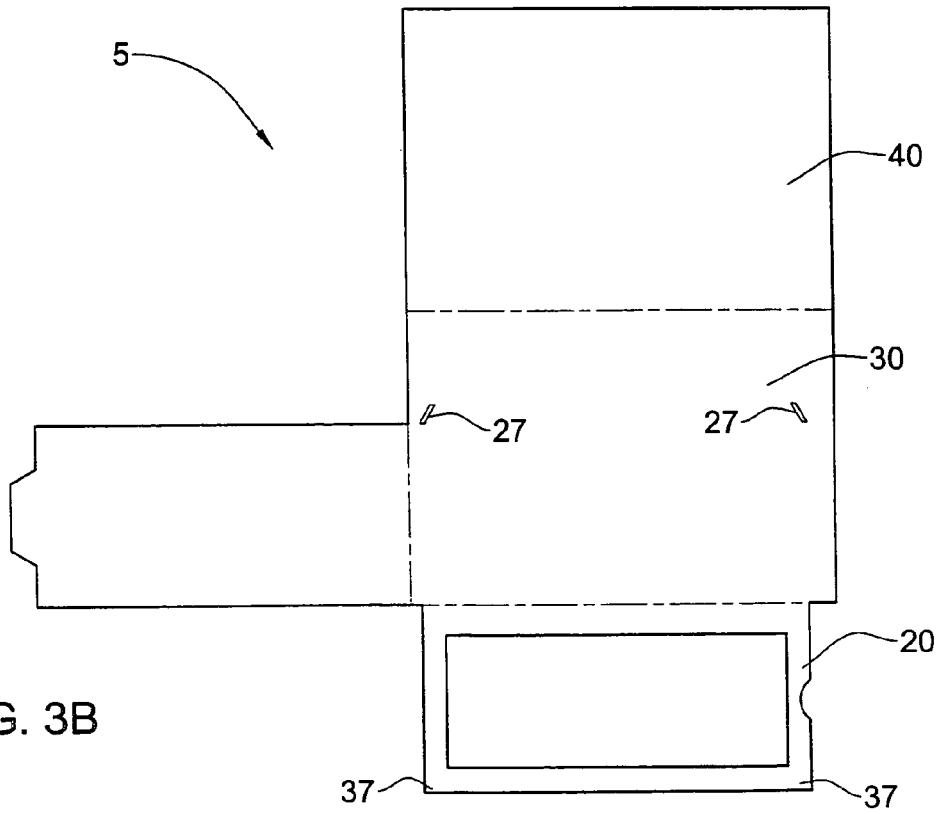

Alternatively, as can be seen in FIG. 3A and FIG. 3B, the second section 30 of the sheet 5 may have a plurality of slits 26 or 27 which may be oriented transversely to the folding line 15. In FIG. 3A, the slits are perpendicular to the folding line 15 and slit-engaging tabs 36 are located at side edges of the first section 20. In FIG. 3B, the slits 27 are oriented at an acute angle to the folding line 15 to receive two respective corners 37 of the first section 20. In both cases, the first section 20 is shorter than the second section 30 in the direction along the folding line 15.

Reverting to FIGS. 1 and 2, the first section 20 is formed with a cutout 45 having a pair of first edges 47 generally co-directional with the folding line 15 and a pair of second edges 49 generally transverse to the folding line 15. One of the first edges 47 is located adjacent to the tab 35, extending along at least most of the tab's length and preferably along most of the width L of the sheet. Thereby, a holding area 50 is formed in the first section 20 between the edge 47 of the cutout 45 and the tab 35, adapted to exert pressure towards the second section when the tab 35 is inserted in the slit 25. This provides a holding force on the flat object 100 when held in the pocket 70 of the greeting card 10. Additionally, the cutout 45 serves as a window in the pocket 70 enabling the recipient of the card to see the flat object 100 held there without taking it out or opening the pocket. The cutout 45 may be made of smaller dimensions than those defined above, when there is no need to form the holding area 50, or to form the window in the pocket 70.

The sheet 5 further comprises a side flap 60 projecting from one of edges 17 of the second section 30, and separated from the second section 30 by an additional folding line 18. The flap 60 has two side edges 62 of which one is co-linear with the folding line 15 between the first and second sections 20 and 30, and a remote edge 64 extending between the side edges 62 and opposite the folding line 18. The remote edge 64 of the flap 60 is spaced from the folding line 18 to a distance substantially equal to that between the folding line 18 and the edge 49 of the cutout which is located farther from the folding line 18. The remote edge 64 of the flap is formed with a tongue 61 so that, when the greeting card is folded as shown in FIG. 4, the tongue 61 engages the second edge 49 of the cutout 45 and the flap 60 covers the cutout 45, thereby giving the pocket 70 and the greeting card 10 further aesthetic value.

FIG. 4 illustrates the greeting card 10 formed with the pocket 70 as shown in FIG. 2. To form the greeting card, the sheet 5 was folded along the folding line 15 and the tab 35 was inserted into the slit 25, which resulted in the first section 20 lying flat over the second section 30 (mostly due to the design of the first section and the location of the slit, as defined above). Thereby, the flat pocket 70 was formed for holding the flat object 100, leaving a part 31 of the second section 30 (FIG. 2) free for adding there greetings or personal notes 32, if desired. After the flat object 100 has been inserted into the flat pocket 70, the flap 60 was folded along the folding line 18 and the tongue 61 engaged the edge 49 of the cutout 45, thus covering the pocket 70. To close the greeting card 10 and to present its front face, which is typically ornamented, the third section 40 is to be finally folded along the folding line 16 to cover the second section 30 with the pocket 70 covered by the flap 60.

Figure 5:
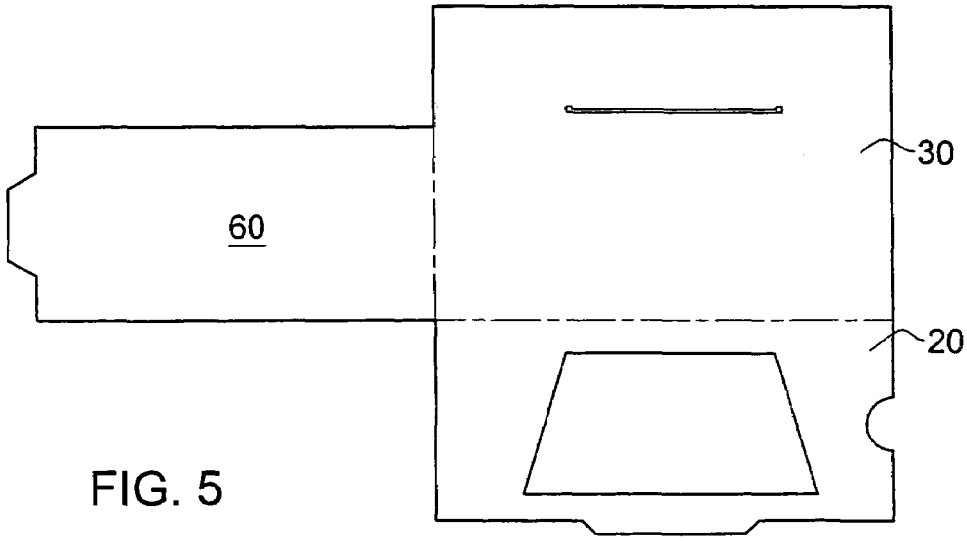
FIG. 5 is a plan view of a sheet of material for forming a greeting card in accordance with still a further alternative of embodiment of the present invention.

It should be understood that a variety of alternatives exist, different from the design described above, to provide a greeting card with a pocket, in accordance with the present invention. Thus, some of the elements of the greeting card 10 may be eliminated. For example, FIG. 5 shows a sheet of material for forming a greeting card without the third section 40. In other embodiments of the invention, the flap 60 or the cutout 45 may not be provided. Also, the pocket 70 does not need to be narrow but may occupy most of the second section, for example for holding a photograph. The flap 60 may be designed for the attachment of its tongue 61 to the second section 30, rather than to the first section 20, e.g. to securely close the pocket 70 at its side opposite the folding line 18 between the second section 30 and the flap 60. More embodiments may, for example, incorporate different shapes of the cutout 45, e.g. as shown in FIG. 5, of the flap 60, of the slits and tabs, or even different shape of the entire card 60.

What is claimed is:

1. A greeting card made of a single sheet of material and adapted for holding a substantially flat object, comprising at least two sections separated by a single folding line, a first of said two sections having a smaller dimension than the second section in the direction perpendicular to said single folding line, wherein one of said two sections is formed with at least one slit spaced from the single folding line and the other section is formed with at least one slit-engaging portion designed for being inserted into said at least one slit when the greeting card is folded along said single folding line, whereby the first section lies flat over the second section and a pocket is formed for holding said flat object, wherein a cutout is formed in the first section, and said second section is formed with a flap at its side separated therefrom by an additional folding line, said flap being adapted to cover said cutout.

2. A greeting card according to claim 1, wherein said second section is formed with said at least one slit and the first section is formed with said at least one slit-engaging portion.

3. A greeting card according to claim 2, wherein said one slit in said second section is generally parallel to said single folding line.

4. A greeting card according to claim 3, wherein said slit-engaging portion of said first section is in the form of a tab formed at the edge of the first section opposite said folding line.

5. A greeting card according to claim 2, wherein said cutout is formed in a position adjacent to said one slit-engaging portion and it extends along at least most of the length of the slit-engaging portion.

6. A greeting card according to claim 5, wherein said cutout enables the substantially flat object, when held in said pocket, to be at least partially seen through said cutout.

7. A greeting card according to claim 1, wherein said second section is formed with a single slit and said first section is formed with a single tab.

8. A greeting card according to claim 7, wherein said flap is detachably attachable to said first section, when folded along said additional folding line and when said greeting card is folded along said single folding line.

9. A greeting card according to claim 1, further comprising a third section substantially equal in size to the second section, separated therefrom by an additional folding line parallel the folding line between the first and second section, such that when the third section is folded along said additional folding line, it covers said second section with said pocket, to form an external face of the greeting card.

10. A greeting card according to claim 2, wherein said second section is formed with a single slit and said first section is formed with a single tab.

11. A greeting card according to claim 3, wherein said second section is formed with a single slit and said first section is formed with a single tab.

12. A greeting card according to claim 4, wherein said second section is formed with a single slit and said first section is formed with a single tab.

13. A greeting card according to claim 5, wherein said second section is formed with a single slit and said first section is formed with a single tab.

14. A card made of a single sheet of material, comprising at least two sections separated by a single folding line, a first of said two sections having a smaller dimension than the second section in the direction perpendicular to said single folding line, wherein one of said two sections is formed with at least one slit spaced from the single folding line and the other section is formed with at least one slit-engaging portion designed for being inserted into said at least one slit when said card is folded along said single folding line, whereby the first section lies flat over the second section, wherein a cutout is formed in the first section, and said second section is formed with a flap at its side separated therefrom by an additional folding line, said flap being adapted to cover said cutout.

15. A card according to claim 14, wherein said flap is adapted to cover the entire first section of the card.

16. A card according to claim 14, wherein said flap is adapted for being detachably attachable to said first section.

17. A card according to claim 14, wherein said flap has one end formed integrally with the card and another end detachably attachable to the first section.

18. A card according to claim 14, further comprising a third section attached, and substantially equal in size, to said second section, the third section being adapted to cover said second section with said pocket, to form an external face of the card.

* * * * *